United States Patent [19]

Long, Jr.

[11] 4,141,454

[45] Feb. 27, 1979

[54] CRANE WITH "Z" CONFIGURED BOOM

[76] Inventor: Willard B. Long, Jr., 1011 Fairground Dr., #12, Salisbury, Md. 21801

[21] Appl. No.: 843,213

[22] Filed: Oct. 18, 1977

[51] Int. Cl.[2] ..... B66C 23/00

[52] U.S. Cl. ..... 212/8 R; 212/39 A

[58] Field of Search ..... 212/2, 8 R, 8 A, 8 B, 212/9, 39 A, 46 R, 46 A, 48, 49, 58 R, 59 R, 59 A

[56] References Cited

U.S. PATENT DOCUMENTS 3,534,355 10/1970 Fathauer ..... 212/2 X

FOREIGN PATENT DOCUMENTS 890736 3/1962 United Kingdom ..... 212/8 A

*Primary Examiner*—Robert G. Sheridan

*Attorney, Agent, or Firm*—Strauch, Nolan, Neale, Nies & Kurz

[57] ABSTRACT

A crane having a boom pivotally mounted mesially thereof to a mast which is itself pivotally mounted on a base platform. A generally horizontally disposed control beam is line attached to the free, rear end of the boom and includes a hydraulic fluid-compression spring control assembly in place of conventional counterweights. Thus, all three units making up the crane have a rough "Z" profile. Mercury switches and pressure actuated switches are provided to activate appropriate warning devices and prevent further operation of the crane in the event of improper boom positioning and/or an overload, respectively.

6 Claims, 1 Drawing Figure

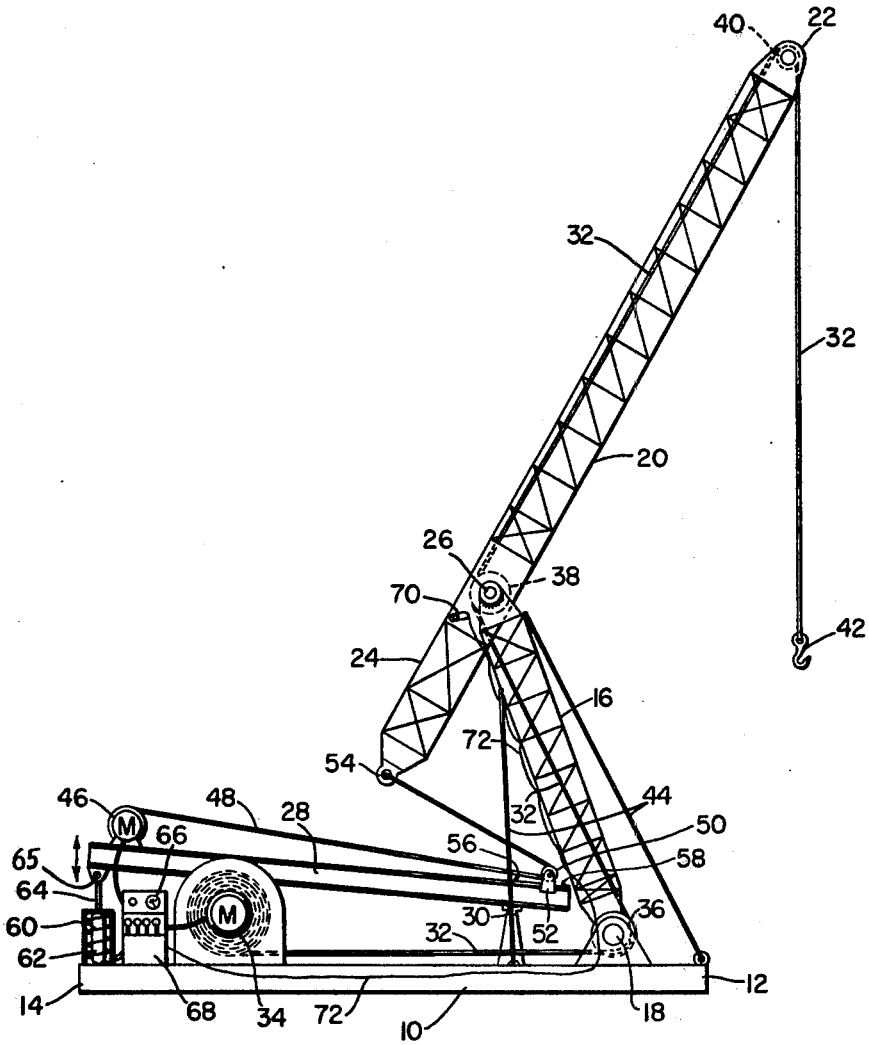
40
22
32
32
20
26
38
70
42
24
16
72
54
46
48
28
32
44
50
66
56
58
65
64
60
30
36
32
52
62
12
14
68
34
72
10
18

CRANE WITH "Z" CONFIGURED BOOM

BACKGROUND OF THE INVENTION

Conventional cranes require massive counterweights assemblies for operation, whether they are of the jib crane or derrick crane variety. Counterweights are not only an added expense of manufacture but also impart unnecessary cost in operation of mobile, vehicular crane systems when moving from one site to another. In addition, added structure is required just to support the load of counterweights whether or not the crane is in use.

Related prior art disclosures discussed in chronological order include prior U.S. Pat. Nos. 1,704,882 issued to P. E. Countryman; 1,871,603 issued to C. D. Ginter; 2,502,108 issued to W. Taylor; and 3,743,049 issued to T. Levrini.

The Countryman patent shows a crane having a boom pivotally supported at about its middle, the angular attitude of the boom being controlled by a hand wheel and screw arrangement at the rear of the boom. Thus, the rear of the boom is lowered in a controlled manner to increase the lift capacity of the crane. However, the mast of the boom are so related as to cause lift forces at the rear of the base when a load is supported and thus conventional counterweighting is mandatory.

The Ginter and Taylor patents also disclose booms pivotally mounted somewhere in their intermediate portions with the disposition of the rear of the boom being controlled so as to increase or decrease lift capacity as required. In the Ginter disclosed structure, the lift cable also controls erection of the derrick boom. However, in the case of both disclosures, load created lift forces are still transmitted to the rear of the crane so that counterbalancing is required to stabilize the crane.

The dual mast or boom structure illustrated in the Levrini patent solves its balancing problem by providing a plurality of counterweights and controls for positioning them, rather than eliminating such structure.

In direct contradistinction to the prior art as specifically disclosed in the foregoing patent disclosure, the present invention provides a crane having uniquely configured and related boom structure wherein lift forces created by load are transmitted to the front of the crane, rather than to the rear where they would have to be counterbalanced. Accordingly, a crane structure is provided capable of supporting a load far in excess of the weight of the crane itself.

SUMMARY OF THE INVENTION

Accordingly, it is a principal object of the invention to provide a crane having a boom structure arranged in a "Z" configuration whereby lift forces created by load are transmitted to the front of the base mounting the crane than to the rear, thus eliminating the need for conventional counterbalancing and providing a crane that may lift a load far in excess of the weight of the crane alone.

It is another object of the invention to provide a crane structure with boom structure transmitting lift forces created by load to the front of the crane and further having alarm and safety control devices for terminating operation of the crane in conditions of improper angular disposition of boom components and/or an overload condition.

It is a further object of the invention to provide a crane structure capable of supporting a load far in excess of its own weight, which is of uncomplicated construction so as to be relatively low in cost of manufacture.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawing which is a partially diagrammatic view in elevation of the invention.

DESCRIPTION OF THE PREFERRED EMBODIMENT

The essential components of the invention as illustrated in the single figure of the drawings include a base or platform 10 having a front 12 and a rear 14, upon which is mounted the crane, comprising a mast 16 pivotally mounted on the platform 10 at 18, a boom 20 having a front, load supporting end 22 and a rear portion 24, boom 20 being pivotally mounted on top of mast 16 at an approximate mid-point of the rear half of boom 20, as indicated at 26, and a generally horizontally disposed control boom member 28, pivotally mounted on platform 10 as indicated at 30, which completes the general "Z" configuration of the overall crane structure.

In a preferred embodiment, the invention will be mounted upon a conventional vehicle (not shown) for transport from site to site as necessary. Such conventional vehicle structure forms no part of this invention per se and accordingly is not illustrated.

Lift cable 32 is cabled from supply drum 34 through a first pulley 36 rotatable about an axis formed by pivot 18 for mast 16, then upwardly through mast 16 to a pulley 38 rotatable about an axis formed by pivot 26 for boom 20. From there, cable 32 is strung through boom 20 and over a pulley 40 as lift end 22 of boom 20, to receive load via hook 42 or other suitable, conventional means.

It should be noted here that mast 16 is located in the forward half of platform 10, toward front end 12 thereof and is rearwardly inclined, preferably at an angle of about 70° with respect to platform 10, as is clearly illustrated in the drawing figure. The angle of inclination is predetermined according to anticipated load, boom length, etc., and then fixed by suitable means such as cables, which are indicated at 44.

The angular inclination of boom 20 is controlled from a drum 46 mounted on control boom 28, having a control cable supply 48 wound thereupon and threaded through a pulley 50, mounted on a movable block 52, slideable along control boom 28, and to the rear end of boom 28, at 54 as shown. Block 52 has limits of travel indicated by stops 56, 58 and is fixed in position prior to operation for reasons to be set forth in greater detail hereinbelow.

At the rear 14 of platform 10 is a double walled cylinder having a compression spring 60 mounted between the double walls and a hydraulic cylinder 62 located in the center, the piston of which is connected by piston rod 64 to the rear of control boom 28, at pivot 65.

Block 52 is fixed by position between stops 56 and 58 at an appropriate position determined by the relative length of boom 20 and mast 16, so that mechanical advantage is employed to operate hydraulic cylinder 62 in a small amount of pounds per square inch, rather than the several tons that may be supported at hook 42.

Cylinder 62 is connected to a pressure gauge 66 on a control panel 68 so that the operator may constantly monitor the load being supported at hook 42. Of course, gauge 66 will be calculated to read tons of load, rather than pounds per square inch actually being transmitted from cylinder 62.

With control panel 68 may be inclined a suitable audio alarm (not shown) which warns the operator of a dangerous overload in the event the operator fails to continuously monitor gauge 66. Of course, the alarm may be connected as desired to the output of hydraulic cylinder 62. Additionally, engine shutdown and/or clutch disengagement means may be incorporated into or in place of the alarm for the sake of safety in case of an overload condition.

Additionally, an inclinometer in the form of a mercury switch 70 may be mounted on boom 20 and be connected by suitable wiring 72 to such alarm and/or shutdown means as discussed above regarding such systems in conjunction with hydraulic cylinder 62. A second mercury switch inclinometer (not shown) could also be used to define a safe limit of inclination in a direction opposite that controlled by switch 70 so as to maintain the angular attitude of boom 20 within predetermined safe limits.

An actual small scale working model of the invention has been constructed, having the following parameters:

| | |
|---|---|
| Weight of platform 10: | 150 lbs. |
| Weight of mast 16: | 70 lbs. |
| Weight of boom 20: | 120 lbs. |
| Remaining elements: | 25 lbs. |
| Total weight of crane: | 365 lbs. |

The rearward inclination of mast 16 was 70° with respect to platform 10 while the forward inclination of boom 20 was 60°, also with respect to platform 10; both of these angles are also shown in the drawing figure. The crane then easily supported a five stage irrigation pump with chain weighing a total of 475 lbs.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A crane comprising: a boom; a generally vertically disposed mast; means pivotally mounting said boom intermediate its rear end and middle on top of said mast; a platform base having a front and rear; means pivotally mounting said mast on said base; said mast and boom being relatively articulated whereby crane lift forces created by a load suspended from the front of said boom are transmitted to the front of said crane base, beneath said boom to thereby eliminate the need for conventional crane counterweighting; and means fixing the relationship of said mast on base in a predetermined angular attitude tilted rearwardly of the front of said base.

2. The crane claimed in claim 1 wherein said mast is mounted approximately medially of the forward one-half of said platform base.

3. The crane claimed in claim 1 wherein said mast is fixed at an angle of about 70° inclination with respect to said platform base.

4. The crane claimed in claim 1, the rear portion of said platform base further comprising means for pivotally mounting a generally horizontally disposed control boom thereon, said boom including means mounted thereon and connected to said first recited boom for governing the inclination of said first recited boom.

5. The crane claimed in claim 4, said platform base rear portion further comprising visual means for continuously monitoring a load supported by said crane.

6. The crane claimed in claim 1, wherein said boom further comprises inclinometer means for indicating a predetermined unstable inclination attitude of said boom with respect to said mast and platform base.

* * * * *